US005534985A

United States Patent [19]

Rosso et al.

[11] Patent Number: 5,534,985

[45] Date of Patent: Jul. 9, 1996

[54] CLEANING DEVICE FOR A FIXING UNIT

[75] Inventors: Luciano Rosso; Antonio Saraceno, both of Turin, Italy

[73] Assignee: Olivetti-Canon Industriale, S.p.A., Ivrea, Italy

[21] Appl. No.: 388,419

[22] Filed: Feb. 14, 1995

[30] Foreign Application Priority Data

Feb. 21, 1994 [IT] Italy ..... TO94A0102

[51] Int. Cl.[6] ..... G03G 21/00; G03G 13/20

[52] U.S. Cl. ..... 355/283; 355/285

[58] Field of Search ..... 355/283, 285, 355/288, 289, 282, 295; 219/216; 15/256.5, 256.51

[56] References Cited

U.S. PATENT DOCUMENTS

| | | | |
|---|---|---|---|
| 3,883,292 | 5/1975 | Hamaker | 432/60 |
| 3,980,424 | 9/1976 | Latone | 432/75 |
| 4,277,161 | 7/1981 | Calabrese | 219/216 X |
| 4,407,219 | 10/1983 | Dellevoet | 118/60 |
| 4,693,585 | 9/1987 | Orbons . | |
| 4,821,077 | 4/1989 | Hayakawa et al. . | |
| 4,926,218 | 5/1990 | Fukao | 355/283 |
| 5,138,390 | 8/1992 | Miyabayashi et al. | 355/283 |
| 5,138,391 | 8/1992 | Takahashi et al. | 355/283 |
| 5,162,634 | 11/1992 | Kusaka et al. | 219/216 |
| 5,327,203 | 7/1994 | Rasch et al. | 355/283 |
| 5,343,278 | 8/1994 | Nakabayashi et al. | 355/283 |
| 5,434,658 | 7/1995 | Kwon | 355/285 |

*Primary Examiner*—R. L. Moses
*Attorney, Agent, or Firm*—Banner & Allegretti, Ltd.

[57] ABSTRACT

The present invention relates to a cleaning device for a fixing unit used, for example in an electric photocopier, for fixing a developed image on a support. The fixing unit is formed by a fuser assembly, in contact with which there moves a film that is rolled up to form an endless belt. The film is set in motion by a drive roller which transmits a drive torque to the belt. The cleaning device removes contaminating particles from the external surface of the drive roller in order to keep constant the coefficient of friction as between the film and the drive roller.

15 Claims, 1 Drawing Sheet

CLEANING DEVICE FOR A FIXING UNIT

BACKGROUND OF THE INVENTION

The present invention relates to a cleaning device for a fixing unit capable of fixing an image produced for example by an electric photocopier or the like on a support essentially formed by a fuser assembly, in contact with which there moves a film that is rolled up in a ring configuration to form an endless belt which is set in motion by an entrainment roller which transmits a drive torque to the film by means of the friction between its external surface and the internal surface of the film with which it is in contact, and more particularly a cleaning device capable of removing contaminating particles from the external surface of the drive roller, keeping it clean for the purposes of maintaining constant in respect of time the coefficient of friction as between the film and the entrainment roller.

A fixing unit is known in the current state of the art, which is formed by:

- a fuser assembly comprising a support of heat-resistant resin, and a heating element fixed to the support and formed by an alumina base on which a resistance means is deposited using the thick-film technology;
- a film of heat-resistant material which is rolled up in a ring configuration to form an endless belt, which moves in contact with the heating element and which is wrapped around two rotatable rollers of which one constitutes the entrainment roller and the other, which rotates idly, constitutes a tensioning roller; and
- a pressure roller which applies a pressure between the support on which the image to be fixed is formed and the fuser assembly, by way of the film.

The drive roller transmits a drive torque to the belt to make it move, by means of the frictional force between its external surface and the internal surface of the belt with which it is in contact; that frictional force depends on the tension of the belt, the angle through which it is wrapped around the drive roller and the coefficient of friction between the two materials constituting the external surface of the drive roller and the internal surface of the belt.

The movement of the film is opposed substantially by a resistant torque generated by the frictional force between the internal surface of the belt and the external surface of the heating element. Various systems are known in the current state of the art for reducing the latter frictional force and to keep it low for as long as possible, for example by depositing a layer of amorphous carbon like diamond on the external surface of the heating element, as described in Italian patent application No TO93A000952.

However those arrangements are not sufficient to guarantee that the fixing unit enjoys a long service life; in fact, with use, the abrasion effect caused by the belt rubbing against the fuser group generates minute particles of the materials which make up the surfaces that are in contact, which particles, being transported by the belt, are deposited and accumulate on the external surface of the drive roller, with the effect of reducing the coefficient of friction between the external surface of the drive roller and the internal surface of the belt, finally causing the belt to slip with respect to the drive roller and resulting in it consequently coming to a stop.

SUMMARY OF THE INVENTION

Preferred embodiments of the present invention provide a device which, without maintenance intervention operations, provides for removing the contaminating particles from the external surface of the drive roller, keeping it clean and thus making the coefficient of friction as between the drive roller and the belt substantially constant for the entire life of the fixing unit.

The invention is defined with more precision in the appended claims to which references should now be made.

BRIEF DESCRIPTION OF THE DRAWINGS

This and other features of the invention will be more clearly apparent from the following description of the new cleaning device for a fixing unit and a preferred embodiment thereof which is made with reference to the accompanying drawings in which.

DESCRIPTION OF THE PREFERRED EMBODIMENT

Figure 1:
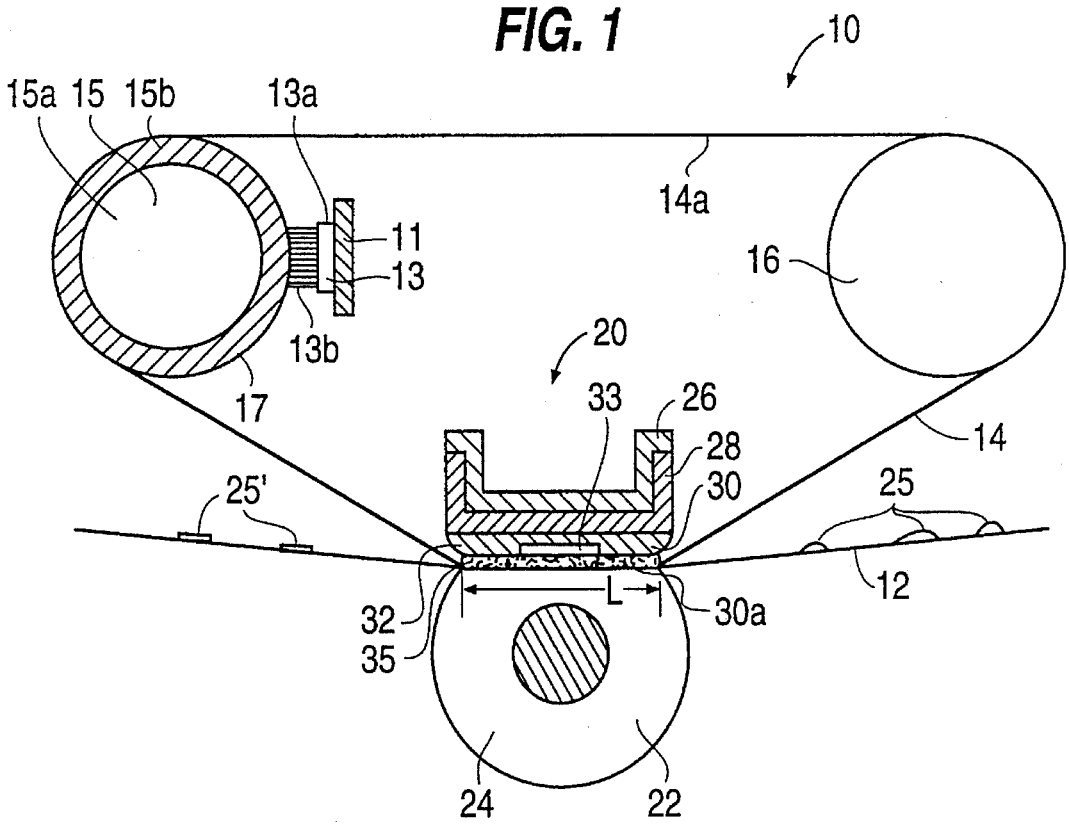
FIG. 1 diagrammatically shows a view in cross-section of a fixing unit which uses the cleaning device embodying to the invention.

FIG. 1 diagrammatically shows a fixing unit 10 formed by a fuser assembly 20 and a film of heat-resistant material which is rolled up in the form of an endless belt 14, which is rotatable about a motor-driven drive roller 15 and an idle tensioning roller 16. A pressure roller 22, which is external to the belt 14 applies a pressure between the fuser assembly 20 and the belt 14. The fuser assembly 20 is formed by a rigid carrier 26, for example of metal, to which a support 28 of heat-resistant resin is secured; fixed on the support 28 is a heating element 30 formed by an alumina base 32 on which a resistor 33 is deposited by means of the "thick-film" technology, which resistor 33 can heat up to a temperature of about 250° C. when it is supplied with a current generated by an electrical power source which is external to the fixing unit. The surface **30*a* of the heating element 30 in contact with the film 14 is protected by an anti-friction and anti-wear layer 35 formed for example formed by glass or by amorphous carbon in the form of diamond or by both deposited in succession. The drive roller 15 is formed by a core 15*a* of steel which is covered by a rubber layer 15*b* while the tensioning roller 16 is entirely of steel and is connected to earth at 9 to remove the electrostatic charges which may be generated on an internal surface 14*a* of the belt 14. The pressure roller 22 which is disposed at a position corresponding to the fuser assembly 20 and externally to the belt 14 is formed by a core 23 of steel which is covered by a thick layer 24 of rubber with high characteristics in regard to resilience (for example silicone rubber), which is capable of deforming under the action of a force applied by means pressure (not shown in the drawing), thereby to form a compressed contact zone "L". When a support 12, carrying an electrostatic image developed with toner 25 and entrained by the belt 14, is caused to pass between the pressure roller 22 and the fuser assembly 20, the toner 25 melts under the combined action of the pressure and the heat transmitted from the heating element 30 through the belt 14 and the fused toner 25', on cooling down, permanently adheres to the support 12**.

As described hereinbefore the belt 14 is caused to rotate by the drive roller 15 by means of the frictional force which exists between an external surface 7 of the rubber layer **15*b* covering the drive roller 15 and the internal surface 14*a* of the belt 14. Various materials are known in the state of the art, which are capable of providing a high coefficient of friction, for example the internal surface 14***a* of the belt 14 is made of polyamide resin and the rubber layer 15*b* is made of silicone rubber, so that at the beginning of operation of the fixing unit 10 the belt 14 is entrained without slipping with respect to the roller 15. With use however a multiplicity of contaminating particles are formed and deposited on the external surface 17 of the entrainment roller 15, progressively reducing the coefficient of friction between the belt 14 and the roller 15. These particles are formed primarily because of the rubbing action as between the internal surface 14*a* of the belt 14 and the protective layer 35 of the fuser assembly 20, and the consequent abrasion. These may also be paper powder and particles of toner which are formed as a result of the movement through the fixing unit 10 of the supports 12 which are mainly formed by pre-cut sheets of paper carrying an image developed with toner 25 which has not yet fused.

The effect of the reduction is increased by the simultaneous increase in the frictional force as between the film 14 and the fuser assembly 20 due to progressive deterioration in the anti-wear and anti-friction layer 35, which is caused by the above-mentioned abrasion effect. This finally results in slippage of the belt 14 with respect to the drive roller 15, with the consequence that the belt 14 stops and the fixing unit 10 is rendered inoperable. In order to counteract the above-described reduction in the coefficient of friction, in this embodiment of the invention use is made of a cleaning device 13 in the form of a small brush, which is fixed to a rigid support 11 and which extends in parallel relationship with the drive roller 15, being disposed inside the belt 14 in such a way as to be in contact over its entire length with the external surface 17 along a generatrix of the drive roller 15. The cleaning device 13 is formed by a support fabric or cloth 13*a* and a plurality of hairs or bristles 13*b* which are in part rigid and in part flexible, wherein the rigid bristles 13*b*' (see FIG. 2) have the task of removing all the contaminating particles which are deposited on the external surface 17 and the flexible bristles 13*b*" have the task of retaining and collecting the contaminating particles, in order to keep the coefficient of friction as between the entrainment roller 15 and the belt 14 substantially constant in respect of time without the need to carry out maintenance operations to re-clean or replace the cleaning device 13 during the service life of the fixing unit 10.

In order effectively to impart the above-mentioned capabilities to the cleaning device 13, both the characteristics of the materials used to form the support fabric 13*a* and the bristles 13*b*, and the geometrical arrangement of the bristles 13*b*, assume relevant importance. In experiments carried out by the inventors the best results were obtained with a cleaning device 13 in which:

the bristles 13*b* are 5–6 mm in height and cover a width of 10–15 mm for a length equal to that of the drive roller 15;

the support fabric 13*a* is formed by a warp of cotton with a yarn of 59 Tex with a density of 16 threads/cm and a weft of rayon/viscose with a yarn of 42 Tex with a density of 14 threads/cm. The preferred range for the density of the warp is between 10 and 30 threads/cm and for the density of the weft is between 5 and 25 threads/cm. The preferred range of weight for the cotton yarn is between 20 nd 120 Tex and for the rayon/viscose yarn is between 10 and 100 Tex;

the flexible bristles 13*b*" are formed by a yarn of polyamide (trade name KEVLAR, registered trademark of Dupont) of 126 Tex formed by 750 elementary filaments, but may be in the range 200 to 1500 filaments of 50 to 500 Tex;

the rigid bristles 13*b*' are formed by a yarn of polyester of 15.7 Tex formed by a single filament of a diameter of 0.12 mm. The rigid bristles may be formed by 1 to 10 filaments of 5 to 50 Tex.

As is known, the Tex is a unit of measurement used in the textile industry to measure the fineness of fibre expressed by the weight in grams of 1000 m of thread (specific weight).

Figure 2:
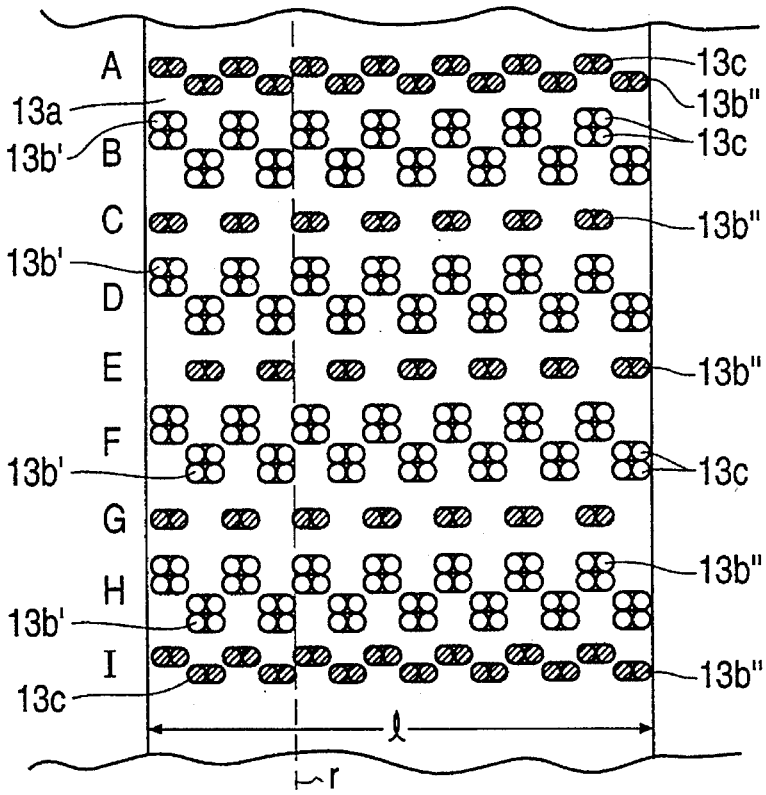
FIG. 2 illustrates the constitution of the cleaning device when applied to the drive roller in FIG. 1.

In addition, the geometrical arrangement of the bristles 13*b* which is found to be more effective on the basis of the experiments carried out by the inventors is that shown in FIG. 2 in which:

the flexible bristles 13*b*" of polyamide are disposed in 5 rows respectively indicated by the letters A, C, E, G and I and extending in parallel relationship with the drive roller 15 and with the interposition of 4 rows of rigid bristles 13*b*' of polyester which are respectively indicated by the letters B, D, F and H. Preferably there are from 2 to 20 rows of flexible bristles and from 1 to 20 rows of rigid bristles;

the first and last rows of flexible bristles 13*b*" which are respectively indicated by the letters A and I are made up of tufts 13*c* which are staggered relative to each other alternately in the direction of rotation of the entrainment roller 15 and which each involve a density of 14 tufts/cm and preferably between 5 and 30 tufts/cm,(in FIG. 2 a portion of width 1 cm of the brush 13 is indicated by the letter "1");

the remaining rows of flexible bristles 13*b*" which are respectively indicated by the letters C, E and G are made up of aligned tufts 13*c* spaced by empty gaps, each involve a density of 7 tufts/cm and preferably between 3 and 15 tufts/cm and are disposed in such a way that rows successively form a chessboard-like design; and the rows of rigid bristles 13*b*' which are respectively indicated by the letters B, D, F and H are formed by pairs of tufts 13*c* which are staggered alternately relative to each other in the direction of rotation of the entrainment roller 15 and each involve a density of 28 tufts/cm and preferably between 10 and 50 tufts/cm.

The term tuft 13*c*, as is known, is used to denote a portion of thread which is inserted into the support cloth and bent in half onto itself in such a way as to present its two ends in side-by-side relationship and projecting from the same part with respect to the support cloth and constituting two distinct individual threads.

In that way 49 tufts 13*c* of polyamide and 112 tufts 13C of polyester are fixed in total on the portion "1" (see FIG. 2) of the support cloth 13*a* and disposed facing each transverse line such as for example that indicated by the letter "r" are 7 individual flexible bristles 13*b*" of polyamide and 16 individual rigid bristles 13*b*' of polyester.

It will be appreciated that the cleaning device according to the present invention may be the subject of modifications in terms of the materials and the arrangement of the bristles, and additions and/or substitutions of parts without however thereby departing from the scope of the invention.

What is claimed is:

1. A cleaning device for a fixing unit which is capable of removing contaminating particles from a surface of a drive roller which imparts motion to a belt for transporting an image support through said fixing unit, wherein said cleaning device is formed by a brush comprising:

a support;

a first multiplicity of rigid bristles fixed to said support and capable of removing said particles; and, a second multiplicity of flexible bristles fixed to said support for retaining said contaminating particles.

2. A cleaning device as set forth in claim 1 wherein said bristles of said first and second multiplicities are produced using a yarn of synthetic fibres, in which yarn used for said rigid bristles is of a first material and yarn used for said flexible bristles is of a second material which is different from said first material.

3. A cleaning device as set forth in claim 2 wherein said first material is formed by a polyester resin and said second material is formed by a polyamide resin.

4. A cleaning device as set forth in claim 1 wherein said rigid bristles and said flexible bristles are fixed to said support in such a way as to form rows which are parallel to each other and to said drive roller.

5. A cleaning device as set forth in claim 4 wherein said rows comprise rows of said flexible bristles which are disposed alternately with rows of said rigid bristles.

6. A cleaning device as set forth in claim 5 wherein said rows of said flexible bristles are between 2 and 20 in number and that said rows of said rigid bristles are between 1 and 20 in number.

7. A cleaning device as set forth in claim 1 wherein said support is formed by a cloth formed by a weft of threads disposed in a first direction, and interwoven with a warp of threads disposed in a second direction perpendicular to said first direction wherein said threads of said weft are formed by a yarn of rayon/viscose and said threads of said warp are formed by a cotton yarn.

8. A cleaning device as set forth in claim 7 wherein said weft is of a density of between 5 and 25 threads/cm and said warp is of a density of between 10 and 30 threads/cm.

9. A cleaning device as set forth in claim 7 wherein said yarn of rayon/viscose is of a specific weight of between 10 and 100 Tex and that said cotton yarn is of a specific weight of between 20 and 120 Tex.

10. A cleaning device as set forth in claim 3 wherein said yarns of polyamide resin and polyester resin comprise a multiplicity of elementary filaments wherein said yarn of polyamide resin is formed by a number of said elementary filaments of between 200 and 1500 and said yarn of polyester resin is formed by a number of said elementary filaments of between 1 and 10.

11. A cleaning device as set forth in claim 3 wherein said yarn of polyamide resin is of a specific weight of between 50 and 500 Tex and said yarn of polyester resin is of a specific weight of between 5 and 50 Tex.

12. A cleaning device as set forth in claim 5 wherein said rigid bristles are inserted into said support cloth in such a way as to form a multiplicity of tufts and wherein said rows of said rigid bristles are formed by pairs of said tufts disposed with continuity and staggered alternately relative to each other in the direction of rotation of said drive roller and each involve a density of between 10 and 50 tufts/cm.

13. A cleaning device as set forth in claim 5 wherein said flexible bristles are inserted into said support cloth in such a way as to form a multiplicity of tufts, wherein said rows of said flexible bristles are formed by said tufts which are disposed in such a way that within each of said rows said tufts are spaced by empty gaps, said rows then being disposed in a chessboard-like design, and each involve a density of between 3 and 15 tufts/cm.

14. A cleaning device as set forth in claim 5 wherein said flexible bristles are inserted in said support cloth in such a way as to form a multiplicity of tufts, wherein said rows of said flexible bristles are formed by said tufts which are disposed with continuity and staggered relative to each other alternately in the direction of rotation of said entrainment roller and each involve a density of between 5 and 30 tufts/cm.

15. A cleaning device as set forth in claim 5 wherein said flexible bristles are inserted in said support cloth in such a way as to form a multiplicity of tufts, wherein said rows of said flexible bristles are subdivided in a first group and in a second group such that said first group consists of said rows of said flexible bristles formed by said tufts which are disposed in such a way that within each of said rows said tufts are spaced by empty gaps, said rows then being disposed in a chessboard-like design, and each row involving a density of between 3 and 15 tufts/cm; and said second group consists of said rows of said flexible bristles formed by said tufts which are disposed with continuity and staggered relative to each other alternately in the direction of rotation of said drive roller and each involve a density of between 5 and 30 tufts/cm.

* * * * *